United States Patent [19]

Franz

[11] 3,973,603

[45] Aug. 10, 1976

[54] CONTROL FOR FILLING FLEXIBLE BOTTLES OR CONTAINERS

[76] Inventor: Henry H. Franz, 3201 Falls Cliff Road, Baltimore, Md. 21211

[22] Filed: June 18, 1974

[21] Appl. No.: 480,505

[52] U.S. Cl. ..... 141/114; 141/313

[51] Int. Cl.[2] ..... B65B 3/16

[58] Field of Search ..... 141/114, 10, 313–317

[56] References Cited

UNITED STATES PATENTS

| | | | |
|---|---|---|---|
| 3,431,703 | 3/1969 | Miller | 141/114 |
| 3,674,060 | 7/1972 | Ruekberg | 141/114 |

*Primary Examiner*—Houston S. Bell

*Attorney, Agent, or Firm*—Kemon, Palmer & Estabrook

[57] ABSTRACT

An apparatus for filling a flexible container with a liquid from a reservoir or tank having a plurality of filling nozzles or tubes. The container engages a nozzle or tube as it is being filled and is subjected to a filling head pressure that causes the sides of the container to distend or expand thus enlarging its volumetric capacity. A control, including a plunger or projector, is provided to engage and indent or compress a side of a container to adjust the volumetric size of the container during the filling operation. Thus, when the head pressure is removed from a filled container, the plunger or projector is moved away from or out of engagement with the side of the container whereby the contraction of the sides of the container will not result in an overflowing or spilling of the contents of the container.

8 Claims, 4 Drawing Figures

CONTROL FOR FILLING FLEXIBLE BOTTLES OR CONTAINERS

BACKGROUND OF THE INVENTION

The present invention is directed broadly to an apparatus for handling fluent material and more specifically to the filling of flexible containers with a fluid. In addition, the invention has special emphasis on controlling the volume of liquid delivered to a container and with preventing the spillage or overflow of the liquid from said container.

The usual bottle or container filling machine or apparatus consists of a reservoir or tank having a plurality of filling nozzles or tubes, each of which is provided with a closure valve to control the flow of the liquid, such as milk, into the bottle or container. The liquid is delivered to the container upon the raising or elevating of said container into sealing engagement with the lower end of the filling nozzle or tube, which action usually results in unseating the valve and permitting the fluid from the reservoir or tank to flow into the container. The filling nozzle or tube usually has associated therewith a vent tube or passage that communicates with a space above the liquid in the tank or reservoir so that as the fluid flows into the container the air contained therein will flow through the vent tube or passage and into the space above the liquid in the tank. The Patent to Minard, No. 2,324,793 of July 20, 1943, is illustrative of filling nozzles for such a machine.

When filling flexible containers or bottles with a fluid, the sides of the container tend to expand under the influence of the fluid being delivered to the container and the head pressure of said fluid. Thus, a gallon type of container would hold more than a gallon of fluid upon the completion of a filling operation due to the sides of the container being distended. In a situation of this type when the container is removed from the filling nozzle which results in a removal of the head pressure, the distended sides of the container will contract resulting in an overflow or spillage of the contents of the container.

SUMMARY OF THE INVENTION

The present invention is directed to the concept of providing an apparatus which will engage at least one side of a flexible plastic-like container so as to indent or compress said side of the flexible container and thereby prevent an enlargement of the volumetric capacity of the container during the filling of the container with a fluid. In the present invention, a flexible plastic-like container engages a filling nozzle to permit the delivery of fluid into said container. During the filling operation, the air within the flexible container is evacuated through a vent tube, associated with the nozzle, so that the container is permitted to receive the fluid from the reservoir or tank. As the container is being filled, the fluid head pressure causes the side of the container to expand or distend thereby increasing the volumetric capacity of the container.

The apparatus of the present invention is adapted to engage at least one side of the flexible container for the purpose of compressing or indenting said side just prior to the completion of the filling operation and the unsealing of the container from the filling nozzle to prevent volumetric expansion of said container. The rapid removal of the apparatus of the present invention from the indented side of the flexible container immediately after the unsealing of the container with the filling nozzle is essential to a correct and proper operation of the present invention. In the filling operation there is a moment after the unsealing of the container from the filling nozzle during which the filling nozzle still extends or projects into the container thus leaving very little headspace in the container. It is, therefore, important that the plunger or projector of the present invention be quickly removed from the indented side of the container. Otherwise, the contraction of the other sides of the container would induce spillage regardless of how much the plunger had indented one side of the container.

Thus, when the head pressure is removed from the container upon the closing of the filling valve, and as the container is being removed from the filling nozzle, the projector that has engaged said one side of the container and indented same is also removed from said container. This action permits this side of the container to expand, in returning to its original or normal condition, which expansion tends to compensate for the contraction of the other sides of the container and thereby offsets the contraction of the other sides and at the same time tends to maintain the flexible container at its normal volumetric capacity.

One of the objects of the present invention is to provide means to counteract the effect of the contraction of a flexible container upon the filling of said container and its release from a filling nozzle and filling head pressure. Another object is to provide an adjustable means for controlling the level of fluid delivered to a flexible plastic-like container which means is associated with the filler valves or nozzles. A further object is to provide means of quick adjustment of the filled level of the container, which adjustment can be accomplished by varying the position of the plunger with respect to the side of the container.

A still further object is to provide means of adjustment of the filled level of the container without varying the position or adjustment of the filler valves, said adjustment being carried out by varying the position of the plunger with respect to the side of the container.

DESCRIPTION OF THE PREFERRED EMBODIMENT

Figure 2:
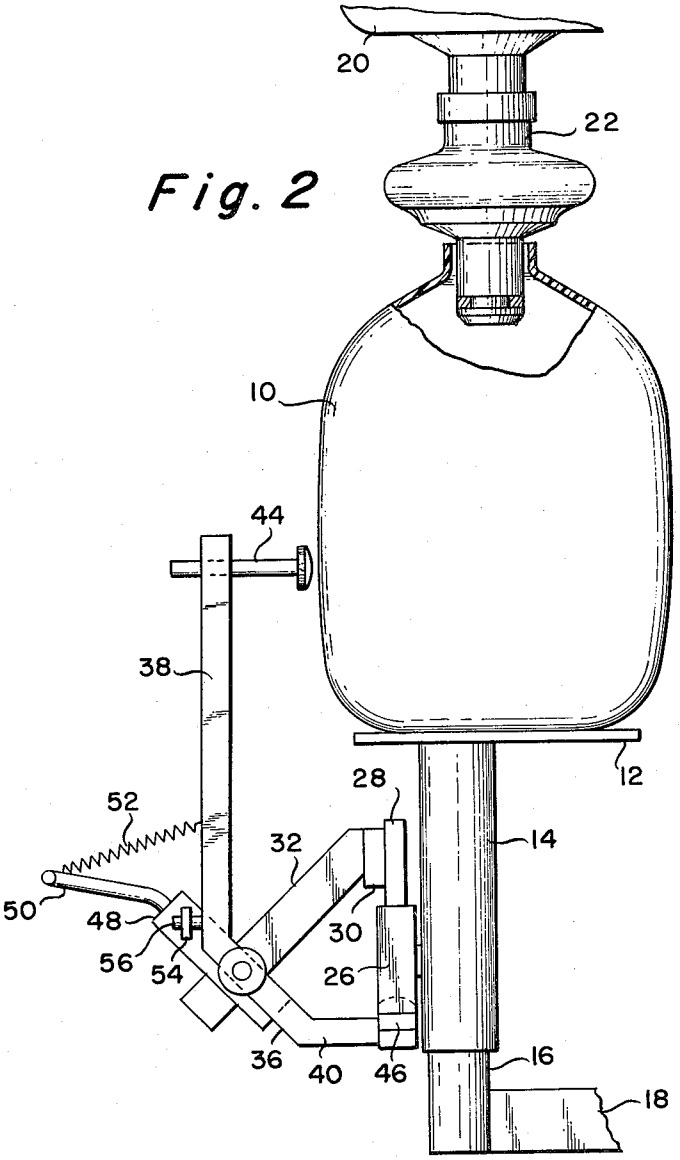
FIG. 2 is a side elevational view of the container filling apparatus shown in FIG. 1 illustrating the condition of the container just after the closing of the filler valve.
Figure 1:
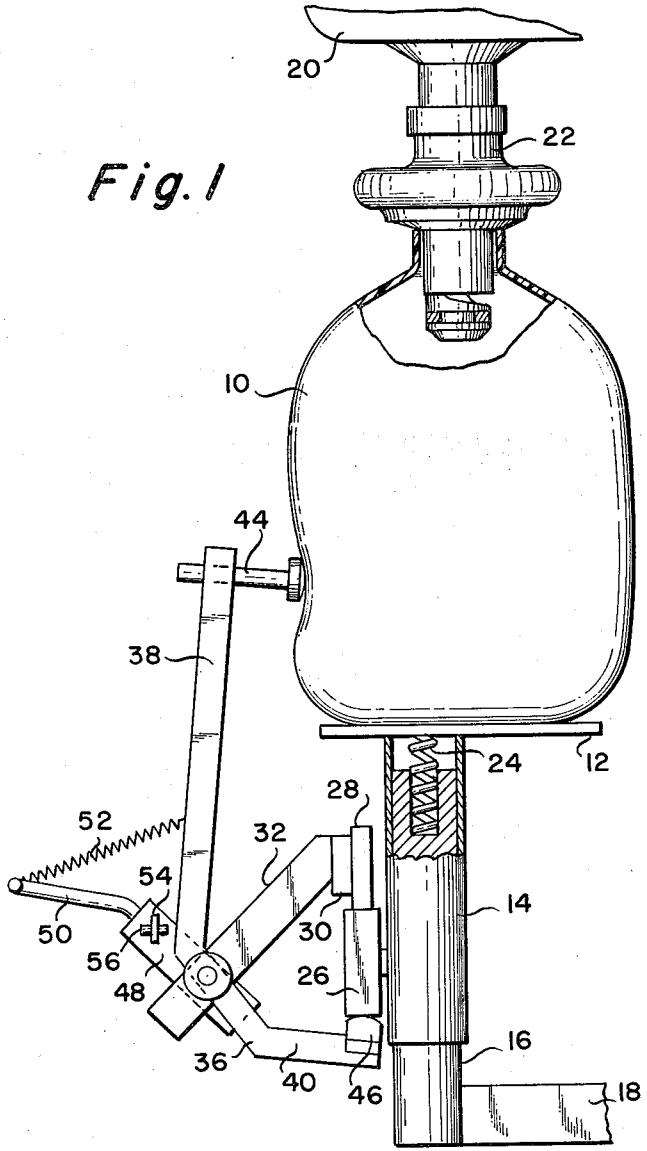
FIG. 1 is a side elevational view of a portion of a container filling apparatus and showing the present invention engaging a container just prior to the closing of the filling valve.

Referring to the drawing there is shown in FIG. 1 a flexible container 10 supported on a pedestal 12 which is provided with a depending tubular sleeve 14 that is slidably mounted upon a vertical post 16. The posts 16 are peripherally supported upon a rotating turret 18. The turret is of a conventional type in a bottle or container filling apparatus and the post 16 and pedestal 12 are illustrative of the structure designed to receive containers for delivery to a filling nozzle during the otation of the turret. The rotating turret 18 also supports a reservoir or tank 20 which is provided with a lurality of filling valves 22 that are arranged in spaced elation to one another. Each filler valve has associated ierewith a vent tube, not shown, for evacuating air nd foam from the container and delivering same into ie air space above the liquid or fluid contained in the eservoir or tank. Suitable means, not shown, are proided for placing the containers 10 upon the pedestals 2 in sequential order as the turret rotates so that the ontainers are moved into engagement with the filling ozzles and are subsequently removed from engageient with said nozzles upon the filling of the container.

The upper end of the post 16 is provided with a reess for the reception of a spring member 24 that is esigned to engage the lower face of the pedestal 12 for rging said pedestal upwardly with respect to the upper nd of said post 16. The tubular member or sleeve 14 of ach pedestal 12 is provided with a roller 26 that is dapted to engage suitable cam tracks to control the ise or elevation of the flexible containers 10 on the edestals 12 into engagement with the filling valves 22 nd to maintain said containers in engagement with aid filling valves during the filling operation of the exible containers. The rollers 26 also engage suitable ams to effect the lowering or withdrawing of the flexile containers from the filling nozzles and to effect the elivery of the filled containers to the discharge mechaism, not shown, associated with the turret 18.

Figure 3:
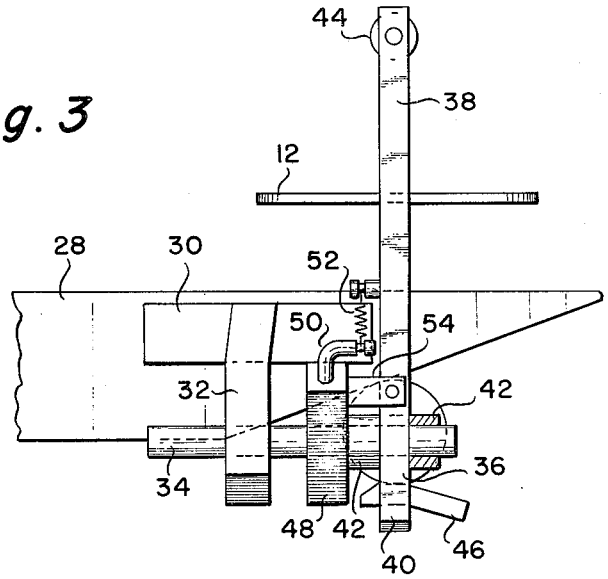
FIG. 3 is an elevational view of the control mechanism of the present invention.
Figure 4:
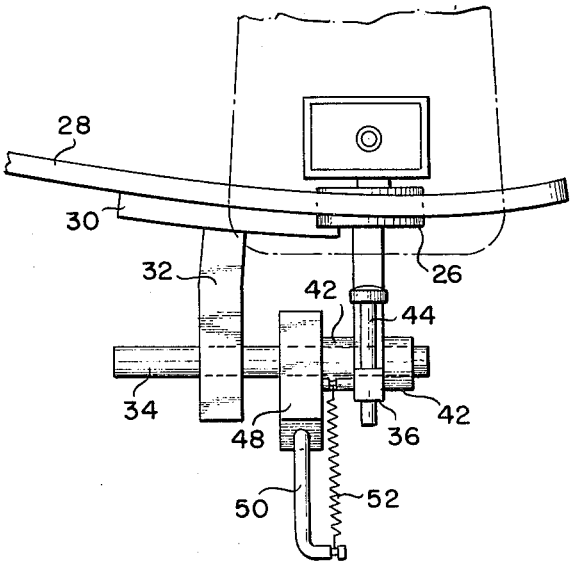
FIG. 4 is a plan view of the control mechanism of the present invention.

Referring to FIGS. 3 and 4 there is shown a stationary am 28 which is the cam that lowers the pedestals 12 nd flexible containers 10 from the filling nozzle or alves 22. The cam has affixed to its outer face a plate iember 30 which in turn has projecting therefrom in a lane normal thereto an arm or bracket 22. The outer r free end of the bracket 32 has adjustably mounted ierein an elongated rod or stud 34 which is disposed in paced parallel relation to the cam 28. Suitable means, ot shown, may be provided in the outer end of the arm 2 for adjustably positioning the rod or stud 34 with espect to the arm or bracket 32. The outer end of the od or stud 34 remote from the bracket 32 has pivotally iounted thereon an angularly shaped lever 36 which is ormed with an upwardly extending segment 38 and at s lower end with an inwardly extending segment 40. he lever 36 is positioned on the end portion of the rod r stud 34 by suitable sleeve or collar members 42 hich are secured to the end portion of the rod 34 by iitable means, not shown.

The upwardly extending segment 38 of the lever 36 as adjustably mounted in the end thereof a plunger 44 hich is positioned to engage a side of the flexible ontainer 10 for the purpose of compressing or indentig said side of the container in the manner as illusated in FIG. 1. The inwardly extending segment 40 of ie lever 36 has mounted on the end thereof a shoe 46 hich is adapted to be engaged by the roller 26 as it ioves along the surface of the cam 28. The rod or stud 4 has mounted thereon adjacent one of the collar iembers 42, a ring member 48 that has secured iereto a post 50 which in turn has a spring 52 conected to its free end and which spring is also conected to upwardly extending segment 38 of the lever 6.

The ring member 48 has a post 54 affixed thereto hich post carries a suitable screw adjustment 56, IGS. 3 and 1, that bears against the upwardly extendig segment 38. The adjustment of the screw 56 against the segment 38 of the lever 36 varies the position of the lever on the stud 34 and thus defines the position of the shoe 46 with respect to the path of movement of the roller as it moves along the cam 28.

In the operation of the present invention a flexible container 10 is delivered to a pedestal 12 and as the turret 18 continues to rotate, the roller 26 will engage a suitable cam not shown, for elevating the sleeve 14 with respect to the post 16 and move the container 10 into engagement with a filling nozzle 22 provided on the reservoir or tank 20. During the continued rotation of the turret 18 fluid is delivered to the container 10 by way of the nozzle 22 and each fluid nozzle comprises a sealing face, a liquid inflow port and a vent tube for discharging air and foam from the container back into the air space above the liquid in the reservoir 20.

The flexible container 10 remains in engagement with the filling nozzle 22 as the turret 18 continues to rotate until such time as the container becomes filled with a suitable fluid, such as milk, with the air from the container as well as the foam created during the filling operation being discharged into the reservoir or tank 20 by way of the vent tube, not shown, through the filling nozzle 22. At this particular time, the sides of the flexible container are distended under the pressure induced by the head of liquid as measured from the side of the container to the level of the liquid in the reservoir or tank 20. At this time a flexible container of say a gallon capacity holds more than a gallon of fluid due to the expansion of the sides of the container because of the head pressure as represented by the depth of the liquid in the reservoir or tank 20.

At this point, the roller 26 engages the cam portion 28 which causes the pedestal 12 and container 10 to commence its downward movement, but before the filling valve 22 has completely closed, the roller 26 approaches and strikes the shoe 46 carried by the inwardly extending segment 40 of the lever 36. This movement of the shoe by the roller 26 rocks the lever 36 about the rod or stud 34 so as to move the upwardly extending segment 38 of the lever, together with the plunger 44, inwardly against the side of the flexible container in the manner as shown in FIG. 1. As the plunger 44 engages a side of the flexible container 10 and compresses said side through the action of the roller 26 engaging the shoe 46, the volumetric capacity of the flexible container 10 is now reduced as some of the liquid in the container is forced back into the reservoir or tank 20 through the filling valve 22.

The plunger 44 remains in contact with the indented or compressed side of the flexible container 10 until the filling valve 22 completely closes and the sealing surfaces between the filling valve and the mouth of the flexible container are separated. At this moment the head pressure, represented by the depth of the liquid in the reservoir or tank 20 and filling valve 22, is released and the three remaining sides of the flexible container are ready to contract. The container 10 at this time, is holding the proper amount of fluid as a result of the plunger 44 compressing a side of the flexible container which action forced some of the fluid back into the reservoir or tank 20. The continued movement of the roller 26 along the cam 28 moves said roller 26 out of engagement with the shoe 46 so that the plunger 44 is withdrawn from the side of the flexible container under the action of the spring 52 and the expansion of the compressed side of the flexible container offsets the contraction of the other sides of the container so that there is no spillage or overflow of the milk from the mouth of the container as the container is moved about the turret 18. The relationship between the unsealing of the filling valve 22 and the flexible container 10 and the release of the shoe 46 from the roller 26 is controlled by the position of the elongated rod or stud 34 in the end of the bracket 32. The stud 34 is capable of axial adjustment in the end of said bracket to vary the position of the shoe 46 with respect to the roller 26 which adjustment would control the relationship between the unsealing of the valve and the release of the shoe from the roller resulting in the withdrawal of the plunger from the side of the container 10.

The screw 56 upon engaging the segment 38 can determine the relationship of the shoe 46 on the segment 40 with respect to the roller 26 moving along the surface of the cam 28. The plunger 44 is adjustably mounted in the upper end portion of the segment 38 so as to control the amount or degree of indentation of the side of the container and thus modify the volume of fill.

Although the foregoing description is necessarily of a detailed character, in order that the invention may be completely set forth, it is to be understood that the specific terminology is not intended to be restrictive on confining and that various rearrangements of parts and modifications of detail may be resorted to without departing from the scope or spirit as herein claimed.

I claim:

1. In a container filling device embodying a rotating turret with pedestals for supporting flexible containers during the filling of said containers from a reservoir having filling valves and means for adjusting the volumetric size of said containers during the filling operation, said means comprising; a cam member, a roller mounted on each pedestal and engagable with said cam for moving said pedestal away from a filling nozzle upon the filling of said container, a lever, means for pivotally supporting said lever with respect to said cam, said lever having an upper end and a lower end a plunger mounted in the upper end portion of said lever, said lower end of said lever having means thereon engagable by said roller for moving said plunger against said container to compress at least one side of said container contemporaneous with the removal of said container from said filling valve.

2. In a container filling apparatus as set forth in claim 1 wherein said first named means includes a stud carried by said cam with said lever pivotally mounted on said stud and said last named means includes a shoe member carried by the lower end of said lever.

3. In a container filling apparatus as set forth in claim 2 wherein said stud has means mounted thereon and engageable with said lever for positioning said lever on said stud to define the position of said shoe member with respect to the path of movement of said roller on said cam.

4. In a container filling apparatus as set forth in claim 3 wherein a spring member is connected to said end portion of said lever and to said stud to withdraw said plunger away from said container as said roller moves out of engagement with said shoe member.

5. In a container filling apparatus as set forth in claim 2 wherein a bracket is secured to said cam and said stud is adjustably mounted in said bracket in spaced parallel relation to said cam.

6. In a container filling apparatus as set forth in claim 5 wherein said stud is provided with a pair of spaced collar members for positioning said lever upon said stud.

7. An apparatus for controlling the volumetric capacity of a fluid in a flexible container during the filling of the container with liquid from a reservoir having a depending nozzle comprising a pedestal for supporting said container and moving same into and out of engagement with said nozzle, a cam member, a roller carried by said pedestal and engagable with said cam, a stud secured to said cam in spaced parallel relation therewith, a lever pivotally mounted on said stud, one end of said lever projecting above said pedestal, a plunger in said end, the other end of said lever engagable by said roller for moving said plunger against said container to compress a side of said container and reduce the volumetric capacity of said container.

8. An apparatus as set forth in claim 7 wherein a spring member is connected to said stud and lever to withdraw said plunger from said container as said roller moves out of engagement with said other end of said lever.

* * * * *